United States Patent [19]

Kelly et al.

[11] 4,107,928

[45] Aug. 22, 1978

[54] THERMAL ENERGY METHOD AND MACHINE

[75] Inventors: John C. Kelly; Brian D. Pardo, both of Reno, Nev.

[73] Assignee: American Solar King Corporation, Waco, Tex.

[21] Appl. No.: 672,457

[22] Filed: Mar. 31, 1976

Related U.S. Application Data

[63] Continuation-in-part of Ser. No. 604,017, Aug. 12, 1975, abandoned.

[51] Int. Cl.[2] ..... F03C 1/00

[52] U.S. Cl. ..... 60/650; 60/530; 60/682

[58] Field of Search ..... 60/530, 650, 682

[56] References Cited

U.S. PATENT DOCUMENTS

| | | | |
|---|---|---|---|
| 2,562,363 | 7/1951 | Nixon | 60/490 X |
| 3,115,160 | 12/1963 | Rogers | 137/625.23 |
| 3,419,827 | 12/1968 | Webb | 137/625.23 |

OTHER PUBLICATIONS

The Literary Digest, Aug. 15, 1931 p. 28.

*Primary Examiner*—Allen M. Ostrager
*Attorney, Agent, or Firm*—Schuyler, Birch, Swindler, McKie, & Beckett

[57] ABSTRACT

This is a method and an apparatus for performing said method, for the conversion of thermal energy into mechanical or electrical energy by means of an exchange of temperature between two water sources having a temperature differential, and utilizing a compressible fluid to be alternately compressed and expanded by the use of the thermal differential, with the flow imparted to the compressible fluid utilized through an improved positive displacement rotary valve and a motor wherein the motor is operated by hydraulic cylinders alternately pressurized and depressurized and connected between a pair of canted discs.

15 Claims, 22 Drawing Figures

230
231
234
9B
220
221
222
224
226
226a
228
228a
8B

THERMAL ENERGY METHOD AND MACHINE

CROSS REFERENCE TO RELATED PATENT APPLICATIONS

This patent application is a continuation in part of application Ser. No. 604,017, filed Aug. 12, 1975, for THERMAL ENERGY METHOD AND MACHINE, and now abandonned.

BACKGROUND OF THE INVENTION

1. Field of the Invention

This invention is in the general field of the conversion of thermal energy to mechanical or electrical energy. The invention is more particularly in the field of the exchange of heat between two fluid sources, and particularly two water sources, one of which is at a higher temperature than the other. It is further directed to the compression and expansion of a compressable fluid by the utilization of the differential in temperature of the two water sources and is particularly directed to the utilization of the compressable fluid to power a motor featuring an improved positive displacement rotary valve and a plurality of hydraulic cylinders causing rotation through alternate expansion and retraction.

2. Description of the Prior Art

The prior art in the utilization of thermal energy and its conversion to mechanical or electrical energy is of course very comprehensive, and a complete listing is not feasible. In general, however, the prior art is limited to the utilization of turbines and other expanders for compressable fluids with the ultimate power being derived through direct expansion within a turbine or other expander.

The present invention is unique in providing a method by which a captive quantity of compressable fluid is alternately compressed and expanded through the use of both heat and mechianical expansion and contraction of the fluid within closed ducts and its transfer by means thereof into hydraulic cylinders through which pistons are actuated to provide a lineal motion which is transferred into a rotary motion through an engine specially constructed of a pair of canted discs carrying the cylinders and their piston rods. There is not prior art utilizing this method.

SUMMARY OF THE INVENTION

There has been a very great amount of development in the use and utilization of thermal energy, particularly during the past few years when the world wide energy crisis has become apparent.

There are many sources of thermal energy, some of which are readily adaptable to utilization in turbines and the like. In general, for effective utilization of such thermal energy sources, the thermal energy source must be of a very high degree, and the usual form of utilization is through the expansion of such heated material such as steam and the like. Such expanded fluid can drive turbines and other mechanical apparatus resulting in the ability to extract mechanical and electrical energy.

A notable weakness in the utilization of thermal energy, however, is the inability to utilize low amounts of captured thermal energy. When such materials as geothermal water sources have been fully expanded in customary expanders, there is still an appreciable amount of energy remaining, but not in usable form due to the relatively low thermal energy and the inability of the material further to expand, resulting in its final condensation into warm water.

Additionally, solar energy is frequently difficult to utilize because of the difficulty in achieving extremely hot temperatures so as to result in a steam source or the like.

We have now developed a complete method and system by which we are able to utilize very small amounts of heat in a very efficient manner through a system of the utilization of a highly compressable fluid such as "Dow 200" as produced by the Dow Chemical Company wherein this fluid is in a captive closed circuit and the fluid is caused to be compressed and moved by means of its exposure, in closed heat exchanger ducts to warmed water, alternately being subjected to a cooler water. Such alternate subjection to different thermal conditions causes expansion and contraction of the fluid by means of the heat itself and by means of the expansion and contraction of the duct material in which the Dow 200 is flowing.

Since this material now has a flow and expansion characteristic, it may be used to drive certain types of mechanisms, and particularly we have found that we can drive hydraulic pistons within hydraulic cylinders in a very efficient manner.

We have now combined this feature with a specially constructed motor which is actually driven by these hydraulic piston and cylinder arrangements. The motor is constructed with the utilization of two discs, each attached to a shaft, and the shaft being appropriately joined by a universal joint, so that the discs may be tilted with relation to one another so that an angular relationship is achieved wherein the discs at one portion of their travel about their axes are closer together than at another position.

With a plurality of hydraulic cylinders fastened to one of the discs about its circumference and rods fastened to the pistons of such cylinders fastened to the other disc about its circumference, as the pistons are moved with relation to the cylinders, the two discs are caused to rotate by means of the pressures being applied and the necessity of movement.

We have achieved a very efficient operation in this manner.

One of the essential features of the motor is an improved positive displacement rotary valve which feeds each cylinder bearing its pressure or expansion and extension stroke, and receives the spent fluid during the return stroke in such manner that by a reversibility of position, the motor is caused to run in one direction or another.

The motor may be utilized by means of appropriate pulley or the like affixed to its output shaft, for direct mechanical driving or it may drive a generator or the like to produce power.

It will now be clear that fluids, particularly water, having a low thermal energy content, such as water heated by solar energy, condensate from turbine operation, effluent from nuclear reactors, and the like, may adequately be utilized in conjunction with a common source of water having a lower temperature gradient to achieve a highly efficient utilization of the relatively small amount of thermal energy still remaining in the fluid. Although we make reference to "relatively small" it is to be noted that this is an extremely large amount of energy but because of the fact that it is not a violent source it is considered small by persons viewing the temperature gradient in terms of degrees.

It is an object of this invention to provide a method and apparatus for extracting thermal energy from water containing a small amount of thermal energy:

Another object of this invention is to provide such a method and apparatus wherein highly efficient use of thermal energy in low temperature waters may be effectively converted to mechanical or electrical energy:

Another object of this invention is to provide a motor for practicing the method of this invention which can operate by the utilization of small amounts of thermal energy gradient:

Another object of this invention is to provide a valve for such a motor wherein the motor is easily reversable.

The foregoing and other objects and advantages of this invention will become apparent to those skilled in the art upon reading the following description of a preferred embodiment in conjunction with the appended drawings.

DESCRIPTION OF A PREFERRED EMBODIMENT

Figure 1:
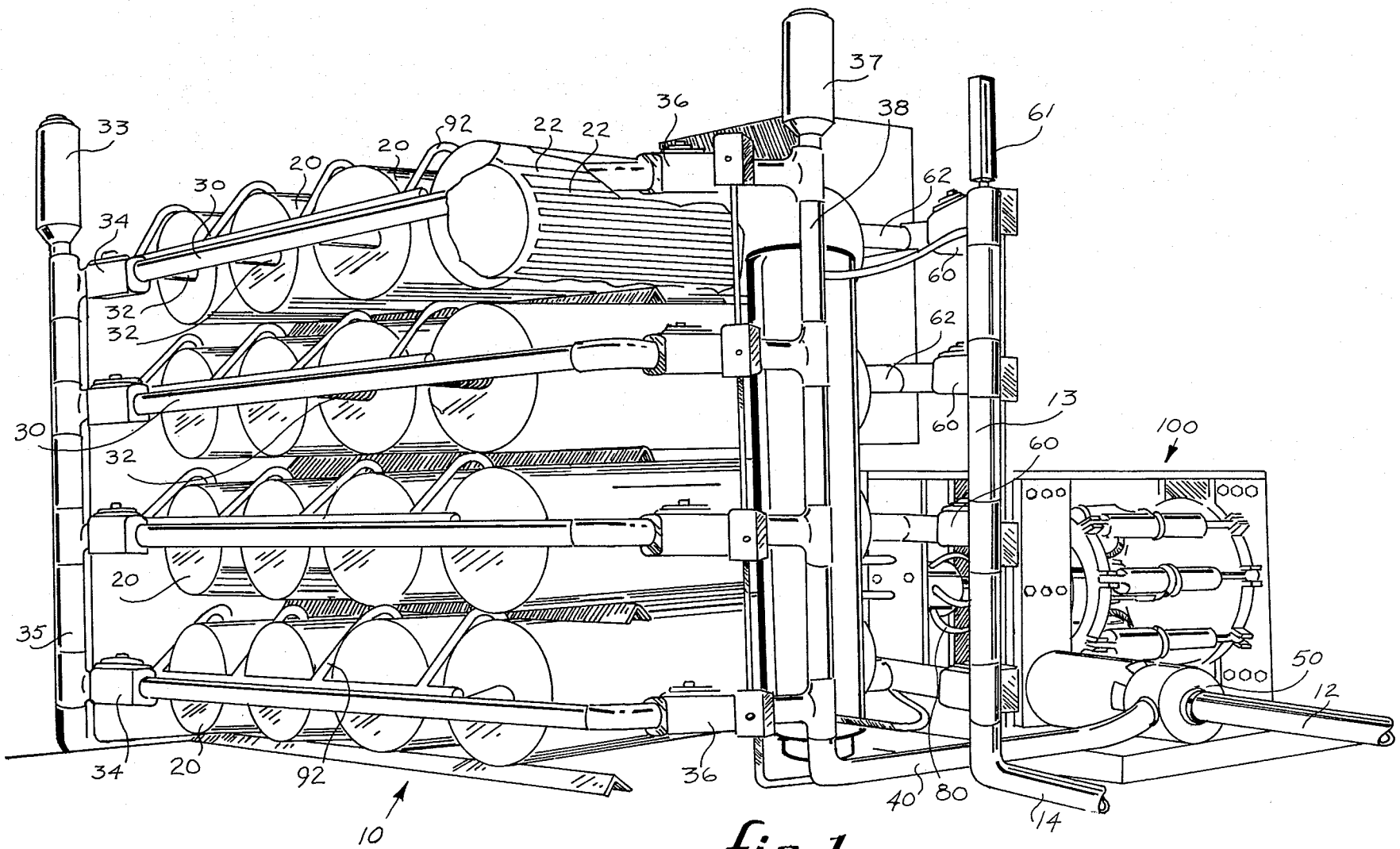
FIG. 1 is a partially broken away perspective of a machine for practicing the method of this invention.

With attention first given to FIG. 1, a series of cylindrical "pods" 20 is illustrated with connecting piping and the like. The motor 100 is also illustrated, as well as a pump 50.

One of the pods 20 is shown partially broken away and a large number of horizontal tubes, or conduit, of a material, preferably having a high thermal conductivity, such as copper, aluminum are shown. These tubes are all interconnected to a source of a compressible fluid as will be more thoroughly outlined in the description of FIG. 2. It is noted that each of the pods has one inlet tube 32 and one exit tube 62. The inlet tubes for a given series of pods are connected to a supply source tubing 30 controlled by valve 34 upon one end and valve 36 upon the other end. Each of these valves works in sequence as will be described in connection with the flow diagram FIG. 3 which will be described hereafter.

Each of the valves 36 is fed from the line 38 connected to piping 40 which is fed by pump 50 and which brings water having thermal energy, through conduit 12. An accumulator or the like 37 is provided to prevent shock as the valves are activated as hereinafter stated.

At the other end of the system, and through the valves 34 and conduit 35, cool water is available.

Figure 3:
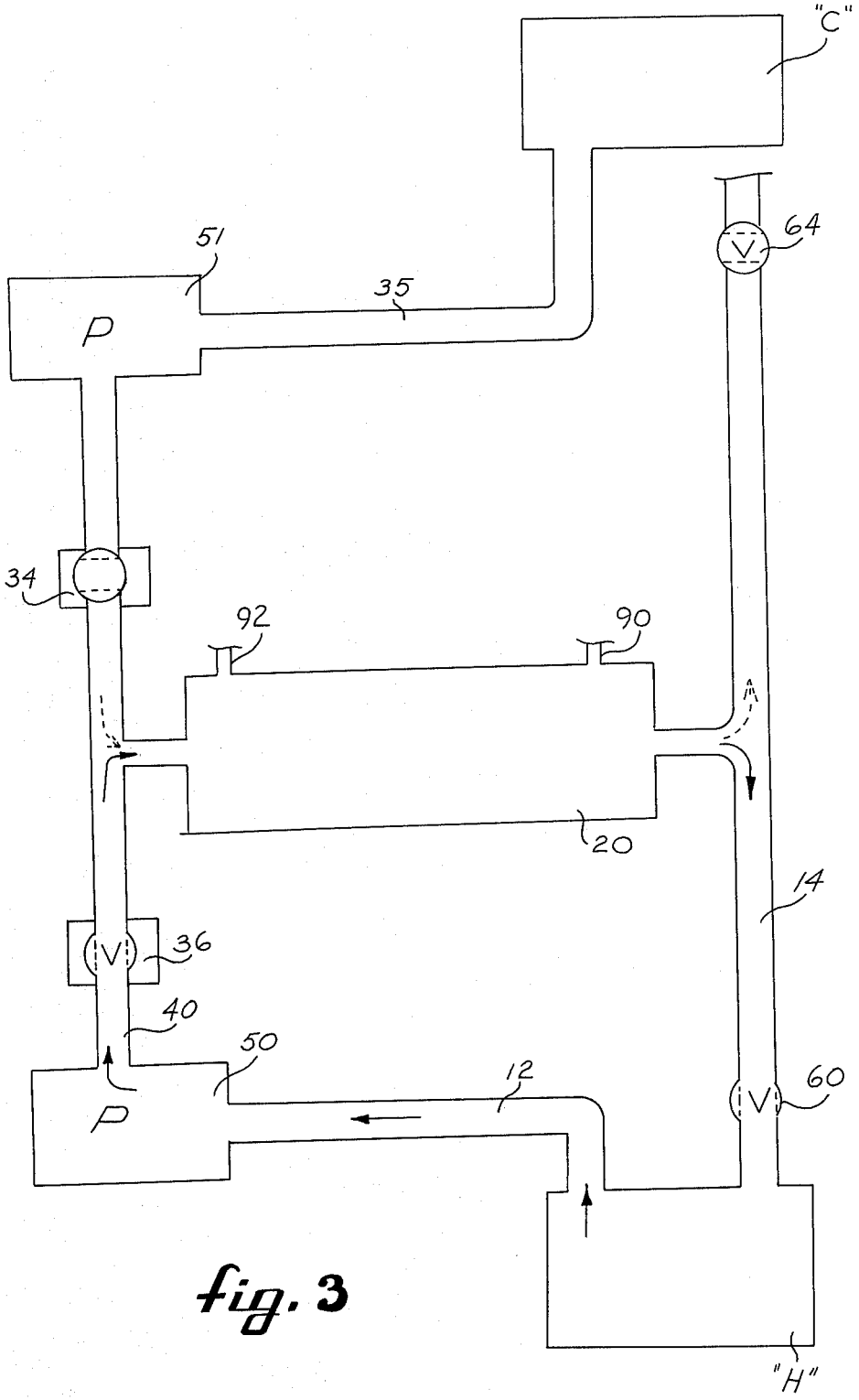
FIG. 3 is a schematic diagram in block form of some of the elements of FIG. 1 showing the water flow.

At the other end of the system, the exit tubing 62 is controlled by valving 60 connected to exit conduit 13–14 for the supply of heated water. A series of valves 64, not visible in this figure but shown in FIG. 3, exist at the othr end of the piping in the manner as shown in FIG. 3 and which will be described further in detail in connection with that figure.

Another element visible in this view is the thermometer 61 by which the temperature of the exit water can be guaged.

It is to be understood that there is electrical wiring, not shown, to control the valves in the manner as will be hereinafter described. It should also be understood, that while a multiplicity of the pods 20 has been illustrated, the system could work upon one pod operating in the fashion shown, but it would be inefficient. With the large number of pods, and each in a specific bank, a preferable system is arranged by which even in the event there should be a valve failure or the like, three quarters of the system would still continue to be actuated and would provide a highly efficient operationin which maintenance can be performed at various times in various sections without interrupting the operation.

Figure 2:
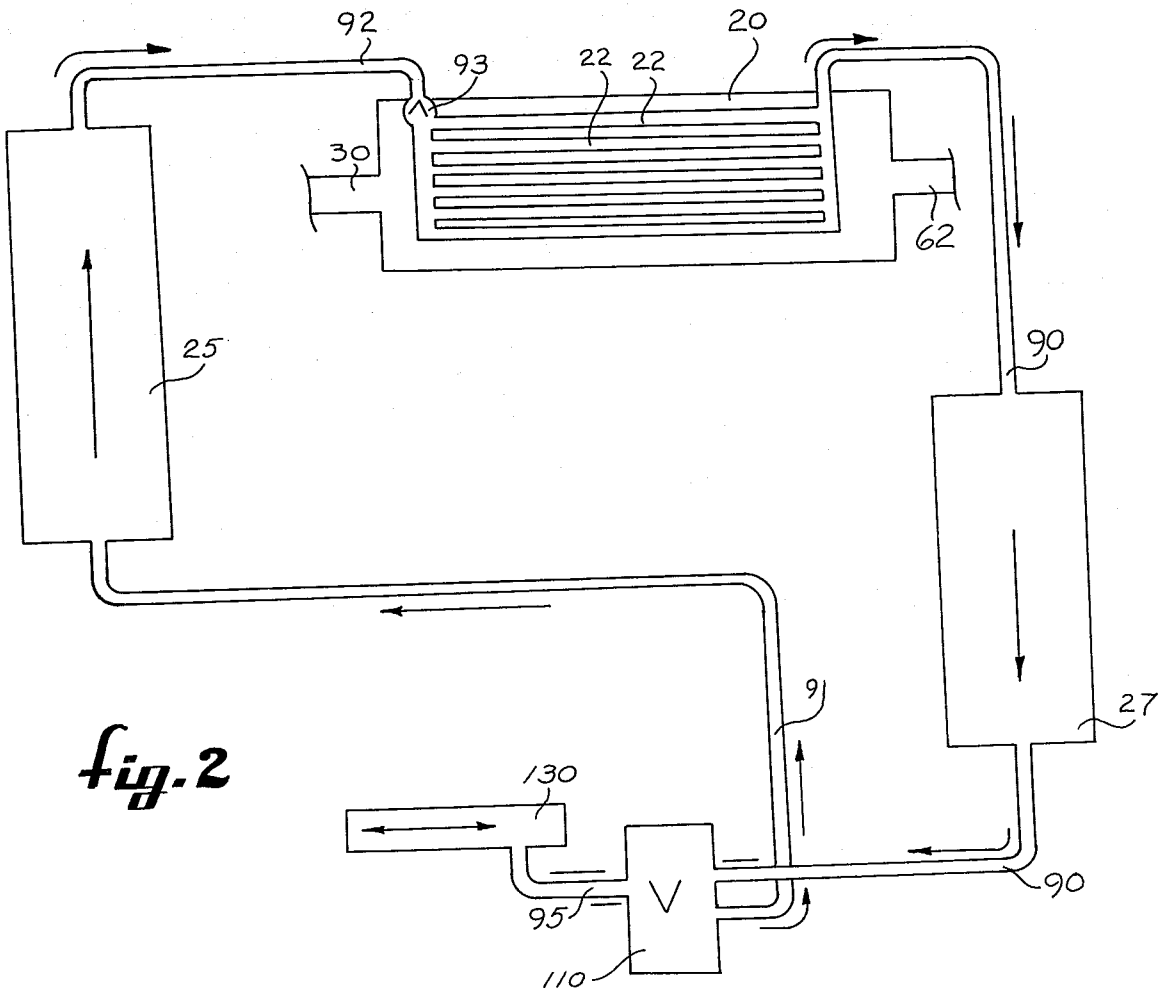
FIG. 2 is a schematic diagram of certain of the elements of FIG. 1 showing the flow of the compressible fluid.

With attention directed to FIG. 2, there is shown one of the pods 20, with its ducting 22 connected upon the pressure side through line 90 and accumulator 27 to valve 110. The unique structure of this valve as well as the improved positive displacement rotary valve, will be further described below. It is to be noted that one conduit is provided for each cylinder 130. The conduit 95 carries pressurized fluid during one half of its cycle and carries the unpressurized return fluid during the other half of its cycle. The unpressurized return fluid returns to line 91 to accumulator 25 and through accumulator 25 by ducting 92 returns to the heat exchange unit and the bank of tubes 22 for the pressure cycle which will hereinafter be recited.

It is to be understood that upon a frequently changing cycle (preferably about every 15 seconds) hot water will enter the pod 20 through the intake pipe 30. The hot water will be exhausted through the exit pipe 62.

During the period the hot water is within the pod 20 it will be apparent that the tubes 22 will not only undergo an expansion, but also the expansible fluid will be inclined to expand because of the heat being supplied.

At the termination of the heating cycle, of whatever duration, whether the 15 seconds specified, or otherwise, the valving will be changed. It is understood that during the heating cycle the valve 36 as shown in FIG. 1 will be open supplying hot water and the valve 60 will be open to return the hot water. When the valve 36 is closed, the valve 34 is open and cold water flows. It will be noted that the valve 60 also closes and the valve 64 for the return or disposition of cooling water will likewise be opened so that there will be a flow of hot water alternating with a flow of cold water through each pod. Normally the sequencing will be as desired so that the various banks of pods will be alternating in order to accomplish a relatively continuous flow of working fluid through the heat exchange ducting. It will be noted that a check valve 93 is provided so that the heated expanded and flowing fluid will not back into the line 92 but will only flow in the direction of work.

The working fluid flows through a secondary accumulator 27 through the valve and by ducting 95 into the cylinder 130. The return working fluid flows through line 91 to accumulator 25 and continues the cycle indefinitely.

In FIG. 3 the water flow is particularly outlined. It will be observed that water from the heated supply "H" passes through pipe 12 to pump 50 from from whence it moves through conduit 40 and valve 36 into pod 20 and through pod 20 returning through valve 60 to the heated supply. During this cycle valves 34 and 64 are closed. When the heat cycle for the pod is complete, valves 36 and 60 are closed simultaneously while valves 34 and 64 are opened. During this cycle, pump 51 pumps cooler water from the cool water supply "C" through ducting 35 and into the pod 20, through the pod 20 and return to the cool supply or for other disposition. The working fluid enters the pod through line 92 and is dispensed from the pod to line 90.

Figure 4:
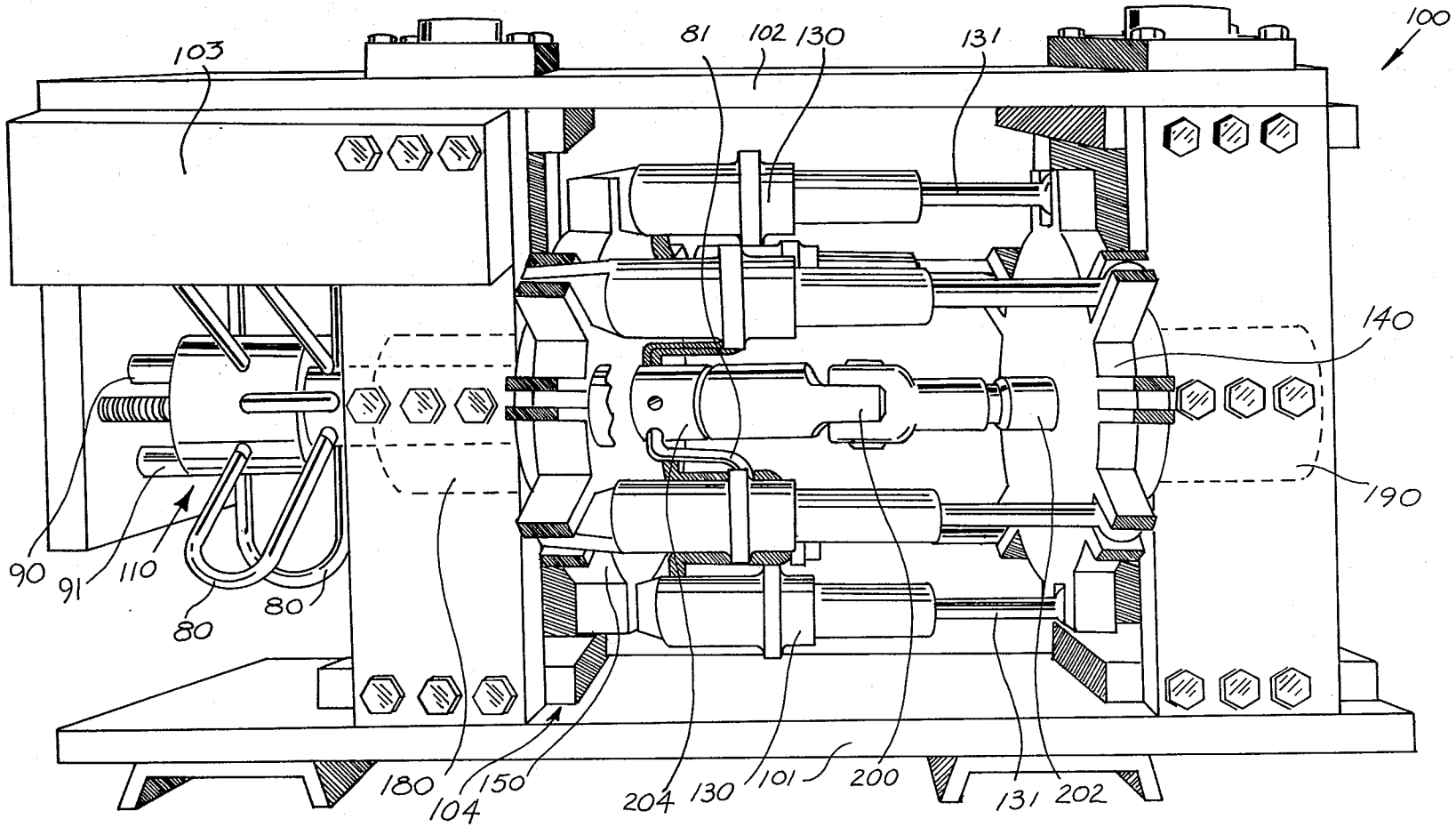
FIG. 4 is a perspective of a motor to practice the method of this invention.

In FIG. 4 the working fluid enters the valve 110 through line 90 and exits through line 91. The exact working of one type of valve will be described below. However, the fluid is dispensed and returned through a series of lines 80 which rotate with the outer portion of the valve and pass through the shaft in a manner known to those skilled in the art and interconnect to the intake port of each of the cylinders 130. This is normally accomplished through a line 81 interconnecting from the hollow shaft to the cylinder.

The motor customarily will be provided with a base 101, additional frame element 102, 103 and the like as will be understood by those skilled in the art. The bearings for shaft 180 and 190 will be carried by movable carriers 104 and 105. The end plates 140 and 150 are mounted upon the shafts 190 and 180 and carried by appropriate bearings as will be understood by those skilled in the art. A suitable universal joint 200 will join shafts 202 and 204 which will be connected by appropriate splined connections or the like to accommodate for different lengths as may be necessary due to the action which will be hereinafter described. The universal joint 200 will be of a customary nature and will allow for the angular rotation of the joining shaft as will be necessary. It will be noted that the cylinders 130 are at different relations to the angularly canted discs 140 so that when a cylinder is being activated under pressure at the closer proximity of the two canted discs, it will tend to move that portion of the discs to a rotated position wherein the elongation and extension of the piston rod 131 can properly take place.

Figure 6:
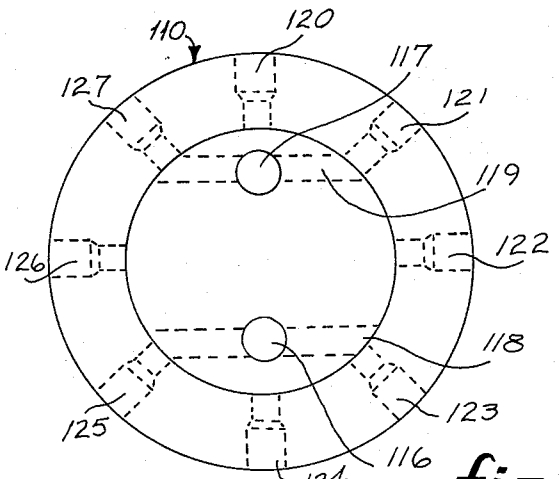
FIG. 6 is an end view of the valve of FIG. 5 with certain inner connections shown in phantom.
Figure 7:
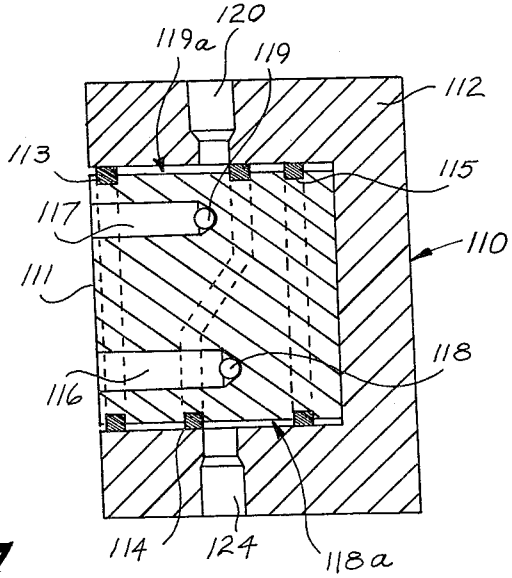
FIG. 7 is a section on 7—7 of FIG. 5.
Figure 5:
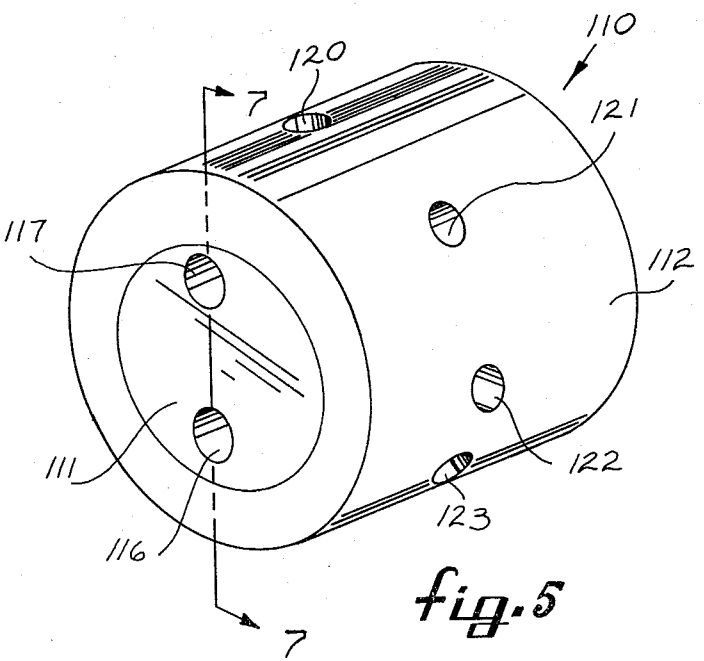
FIG. 5 is a perspective of a control valve for the motor of FIG. 4.
Figures 8A, 8B, 8C, 9A, 9B, 9C:
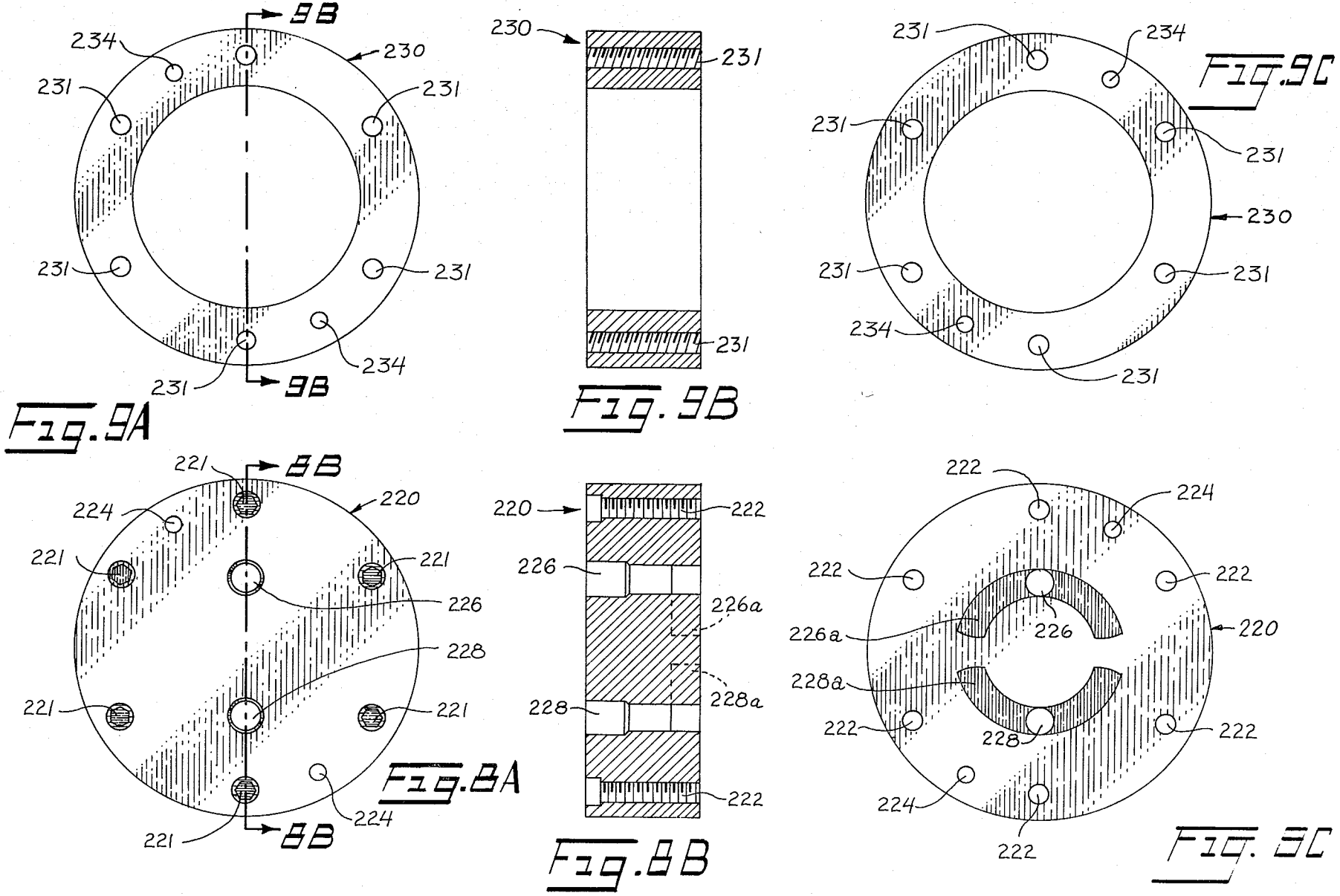
FIG. 8A is an end view of a stationary head of the improved positive displacement rotary valve.
FIG. 8B is a sectional view taken on line 8B—8B of FIG. 8A.
FIG. 8C is an end view of the stationary head shown in FIG. 8A but taken from the opposite end of the head.
FIG. 9A is an end view of a piston housing of the improved positive displacement rotary valve.
FIG. 9B is a sectional view taken on line 9B—9B of FIG. 9A.
FIG. 9C is an end view of a piston housing opposite to the end viewed in FIG. 9A.
Figure 10A:
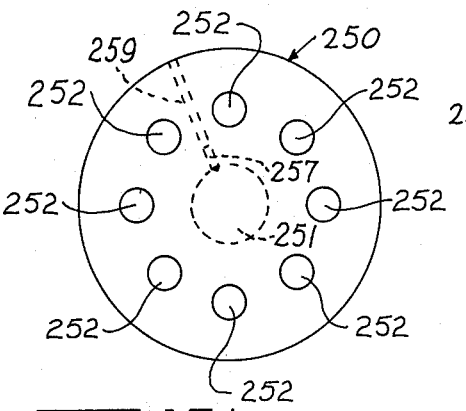
FIG. 10A is an end view of a rotating piston of the improved positive displacement rotary valve.
Figure 10B:
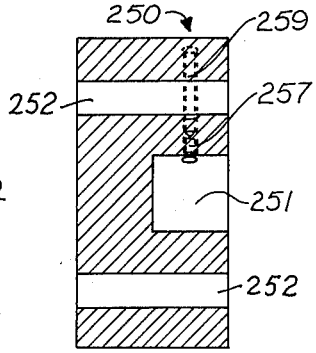
FIG. 10B is a sectional view taken on line 10B—10B of FIG. 10C.
Figure 10C:
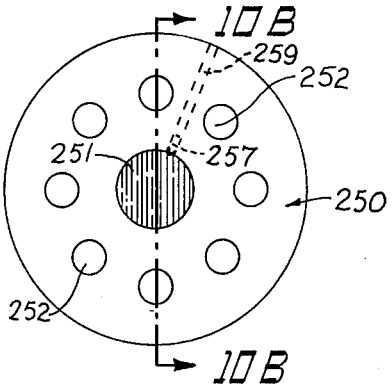
FIG. 10C is an end view of a rotating piston as shown in FIG. 10A taken from the opposite end of the piston.

FIG. 5 illustrates one type of valving arrangement. The stationary portion of the valve, 110, is a cylindrical element essentially as shown, having two holes 116 and 117 drilled a portion of its length. The hole 117 terminates in a cross conduit 119 and the bore 116 terminates in a similar manner with the bore 118 each of which extends through the cylinder 111 as shown. This is particularly illustrated in FIGS. 6 and 7, and in FIG. 7 it will be particularly noted that there is a space **119*a* and 118*a* between the element 111 and the outer cup shaped cylinder portion 112. An "o" ring or the like 113 is provided to prevent fluid from discharging and another "o" ring 115 is provided as shown for the same purpose. An "o" ring 114 is provided intermediate "o" rings 113 and 115 for the purpose of defining two separate cavities as the element 112 rotates about the section 111. A series of openings 120, 121, 122, 123, 124, 125, 126, and 127 have been provided about the circumference as shown. It will become clear that depending upon the position of the particular opening at any given time it will either be receiving pressurized fluid through the space 119*a*, or depressurized fluid through the space 118*a*. During the pressure stroke, the fluid will be flowing through the space 119*a* into the appropriate feed conduit and will be pressurizing the appropriate cylinder. Upon the return stroke, the fluid will return through the opening 124 into the space 118 and will be expelled through the conduit 116**.

Although not specifically shown in detail, the element 112 will be connected to and rotate with the shaft 180 of the motor.

For reasons of clarity, the side view of FIGS. 8–11 does not show all details in phantom.

Figure 11B:
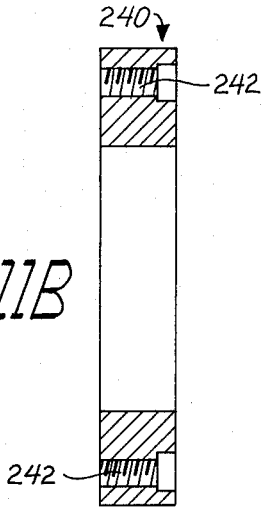
FIG. 11B is a sectional view taken on line 11B—11B of FIG. 11A.
Figure 11A:
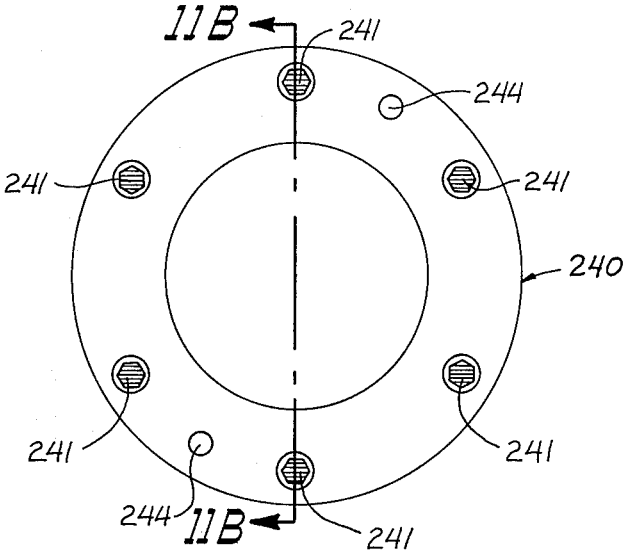
FIG. 11A is an end view of an end plate of the improved positive displacement rotary valve.

FIGS. 8–12 illustrate the improved positive displacement rotary valve. The stationary head 220, FIG. 8, the piston housing 230, FIG. 9, and the end plate 240, FIG. 11, are all stationary while the rotating piston 250, FIG. 10, rotates in communication with the universal joint coupled drive shaft **200*a*, FIG. 13. This universal joint drive shaft is also shown on FIG. 4 as 200**.

Figure 12:
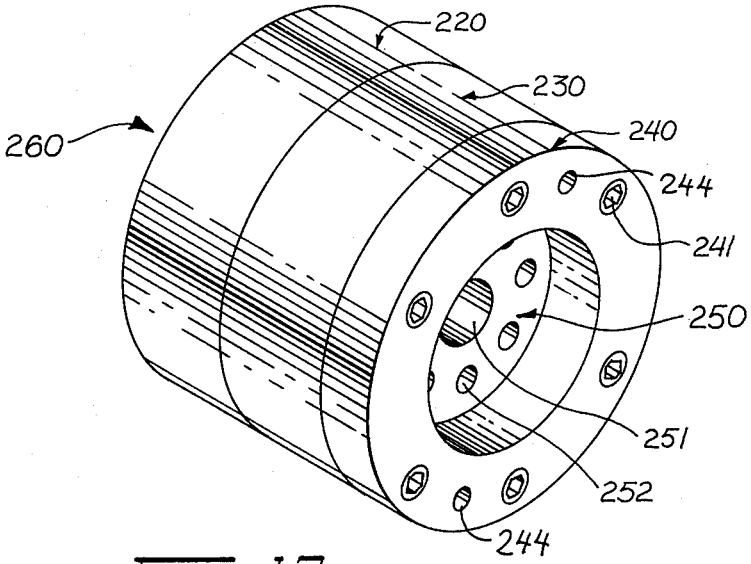
FIG. 12 is a perspective view of the assembled positive displacement rotary valve.

FIG. 12 displays the combination of component parts in relation to the assembled positive displacement rotary valve unit 260.

The stationary head 220, the piston housing 230 and the end plate 240 are fastened together by a means such as bolts 221 and 241 inserted from opposite ends into threaded holes 222, 231 and 242. Aligning pins inserted into 224, 234 and 244 will insure proper alignment of units 220, 230 and 240.

Figure 13C:
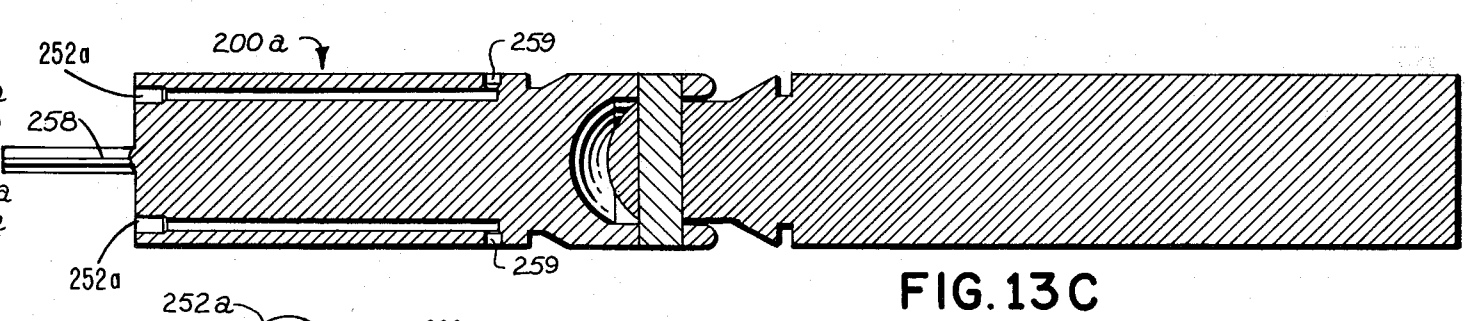
FIG. 13C is a sectional view taken on line 13C—13C of FIG. 13B.
Figure 13B:
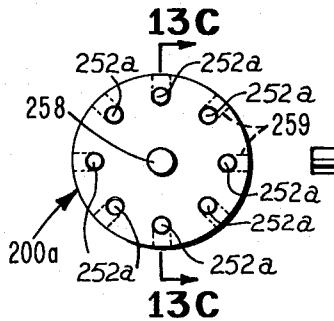
FIG. 13B is an end view of the joint coupled drive shaft shown in FIG. 13A.
Figure 13A:
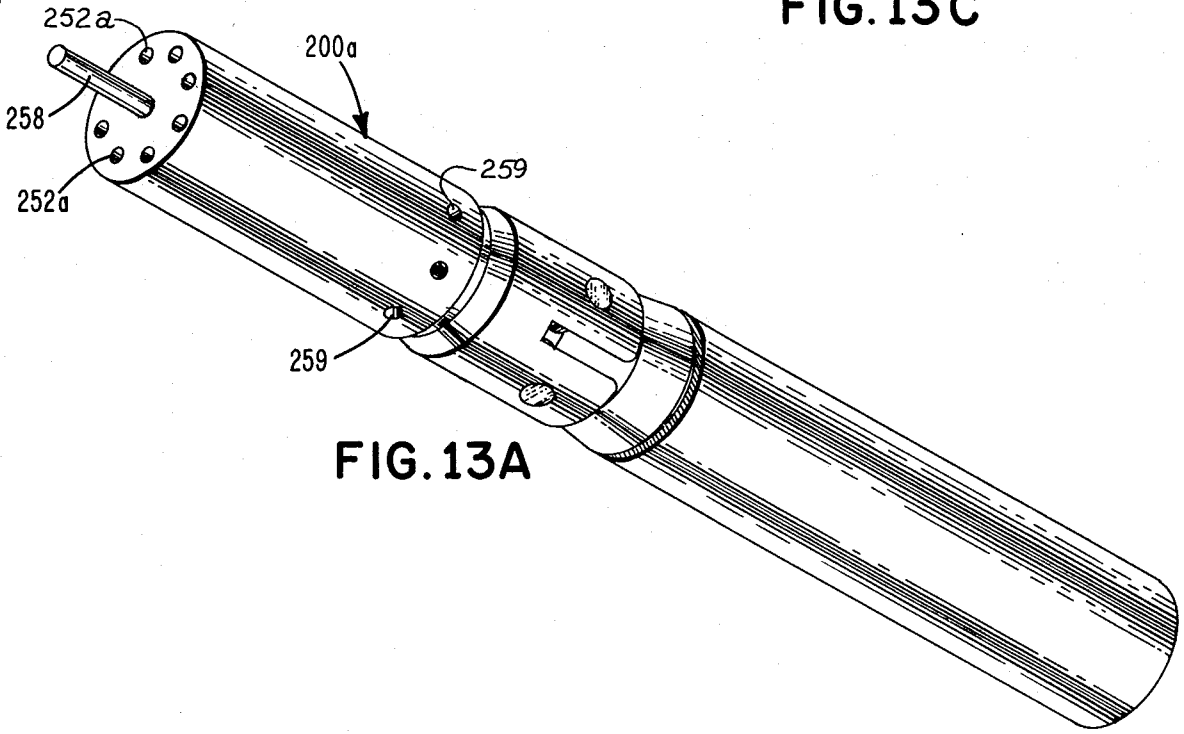
FIG. 13A is perspective view of a universal joint coupled drive shaft.

Rotating piston 250 fits within piston housing 230 with adequate clearance so that rotation is possible. Shaft 258, FIG. 13, is inserted into the rotating piston 250 at chamber 251, FIG. 10, and secured by means of a set screw 257 within the set screw port 259, FIG. 10. Holes 252, FIG. 10, must be aligned with holes **252*a*, FIG. 13, to form ducts between ports 226, 228, FIG. 8, and Ports 259, FIG. 13**.

The positive displacement rotary valve operates in the following manner. In reference to FIGS. 2, 4, and 8–13, pressurized working fluid enters the fluid inlet port 226, FIG. 8, and fills Trough **226*a*. As holes 252 in rotating piston 250, FIG. 10, come in contact with Trough 226*a*, cooperating ports 252*a*, FIG. 13, will allow the appropriate pistons, see FIG. 4 nos. 130** and 81, to expand due to the pressurized fluid. Since canted discs 140, FIG. 4, are closer at the upper portion of rotation, expansion of the pistons at this area will tend to rotate the disc to a lower position where the piston expansion can properly take place.

As the canted discs rotate downward about their axis, fluid is dispensed from the appropriate pistons via 252*a*, 252, exhaust port troth 228*a*, and fluid exhaust port 228. When fluid is dispensed from the pistons, contraction takes place and this happens as the piston reaches the lower portion of rotation or where the canted discs are farther apart. FIG. 2 illustrates the over all cycle in reference to pressurized-unpressurized fluid flow.

With this description, it will be clear that the overall operation of the system is as follows:

1. Hot water will be pumped into one or more of the individual pods, through the pods, and return to the hot water supply. When the working fluid conduit 22 within the pod receiving the hot water has been adequately heated and the conduits 22 have been adequately expanded, the hot water supply will be isolated from the particular pod by closing of the hot water valves and a simultaneous opening of cold water valves will take place so that cold water now flows through the pod. During this cycle the working fluid conduits within the pod will contract. When sufficient cooling has taken place the cycle will be repeated with hot water again going to that pod. Thus it will be seen that there is an alternating flow of working fluid through the conduits.

2. The working fluid passing through the conduits enters through a joint connection to the valve 110 or 260. 3. From the valve 110 or 160 the working fluid pressurizes a cylinder and forces the piston to extend its rod thus causing the canted plates to move so as to achieve a position of greater distance between them. When the maximum distance has been achieved, the valve will have rotated to the position where the fluid connection of the hydraulic cylinder will have passed the pressurized area of the valve and fluid will now tend to return through the return valve.

4. Since there are a number of series of pods, each operating in a cycle, there is somewhat of a pulsation as to each individual working fluid exchanger, but the sum total results in a constant pressure.

5. By altering the amount of the angular displacement between the two canted discs in the motor, the amount of force required to rotate the discs is changed in such manner that greater or lesser force may be extracted depending upon the available thermal energy.

While the embodiment of this invention specifically shown and described is fully capable of achieving the objects desired, it is to be understood that such embodiment has been specifically shwon for purposes of illustration only, and not for purposes of limitation.

We claim:

1. The method for utilization of thermal energy from a fluid comprising:

pumping fluid containing thermal energy into a container having a heat exchanger therein with a working fluid which flows into and out of said heat exchanger and in an isolated part of the heat exchanger;

discontinuing the flow of fluid containing thermal energy to said container and pumping a second fluid having a different amount of thermal energy to the same container;

causing the working fluid to be introduced into at least one hydraulic cylinder;

causing the piston within said hydraulic cylinder to move by reason of the introduction of the working fluid therein;

and utilizing the movement of the piston to provide mechanical energy.

2. The method of claim 1 wherein a series of containers are alternately subjected to the alternate flow of fluids containing different degrees of thermal energy and wherein the working fluid is connected between each of the different containers by means of heat exchangers within each container.

3. The method of claim 2 wherein a multiplicity of cylinders are utilized, and wherein at least one cylinder is receiving a working fluid while at least one other cylinder is discharging the working fluid.

4. The method of claim 3 wherein each of said cylinders is connected at a point adjacent the circumference of a disc, and each of said pistons is attached to a rod with each of said rods being connected to a point adjacent the circumference of a second disc, and in which said discs are canted with relation to one another wherein alternate extension and retraction of the pistons causes rotary motion of the discs.

5. An apparatus for converting thermal energy to mechanical energy comprising a container for fluid having an inlet and an outlet; means connected to the inlet to provide alternately a first fluid having one degree of thermal energy and a second fluid having a second degree of thermal energy; means connected to the outlet to discharge alternately the fluid contained in the first degree of thermal energy and the fluid having the second degree of thermal energy; heat exchange means containing a working fluid contained within said container; means connecting with said heat exchange means to supply said working fluid into said heat exchange means; means connected to said heat exchange unit to exhaust said working fluid out of said heat exchange means; means connected to said exhaust means to transfer said exhausted fluid to a mechanical device; and means connected to said mechanical device to remove said working fluid when the same has been utilized.

6. The apparatus of claim 5 wherein the means to utilize said working fluid is a hydraulic cylinder.

7. The apparatus of claim 6 wherein a plurality of containers is provided each of which has a heat exchange unit and in which all heat exchange units are interconnected to a common source and exhaust of working fluid.

8. The apparatus of claim 7 in which there are a plurality of hydraulic cylinders connected to the source of said working fluid.

9. The apparatus of claim 8 wherein the plurality of hydraulic cylinders are connected to the circumference of a disc and each piston has a rod connected to the circumference of another disc located at an angular relationship to the first disc in such manner that upon extension of the rod the two discs are caused to turn.

10. The apparatus of claim 6 wherein the means to transfer said exhausted working fluid to a hydraulic cylinder comprises: stationary means to receive said exhausted working fluid; and, rotating means, cooperative with said stationary means, to relay said exhausted working fluid to the hydraulic cylinder.

11. The apparatus of claim 10 wherein the means to remove said working fluid from the hydraulic cylinder comprises: rotating means to remove said working fluid from the hydraulic cylinder; and, stationary means, cooperative with said rotating means, to relay said removed working fluid.

12. The apparatus of claim 11 wherein the means to transfer said exhausted working fluid to the hydraulic cylinder, and means to remove said working fluid from the hydraulic cylinder comprises: a first disc penetrated by at least two bores which parallel the axis of said first disc, said bores diametrically opposite, one above the axis and one below the axis, both bores located at the same radial distance from the axis; a second disc penetrated by bores, the bores located at the same radial distance from the axis, said radial distance being the same as in said first disc; a shaft partially penetrated by bores which parallel the axis of said shaft, said bores in the shaft to cooperate with said bores in said second disc so that continuous channels will extend from said second disc and partially into said shaft; means to fasten said shaft to said second disc so that both rotate on a common axis, said means to also keep said second disc in flush contact with said first disc but said first disc to remain stationary along the common axis; radial bores extending from the inner termination end of said bores within said shaft to the exterior of said shaft; conduit means to connect one of said radial bores to the hydraulic cylinder; conduit means connected to the upper bore, in said first disc, to enable transferring said exhausted working fluid to the cylinder; and, conduit means connected to the lower bore, in said first disc, to enable removing said working fluid from the cylinder.

13. The apparatus of claim 12 wherein said discs are canted, said shaft is the connecting means for said canted discs, said canted discs being closer at the top point of rotation than at the bottom point of rotation.

14. The apparatus of claim 13 wherein said cylinders are conduitly connected to said radial bores.

15. The apparatus of claim 14 wherein said cylinders, at an upper point of rotation, will receive working fluid and the rod will extend while said cylinders, at a lower point of rotation, will exhaust working fluid and the rod will contract, all being caused by said bores in said shaft and said second disc aligning with said bores in said first disc during the rotational process.

* * * * *

Notice of Adverse Decision in Interference

In Interference No. 100,356, involving Patent No. 4,107,928, J. C. Kelly and B. D. Pardo, THERMAL ENERGY METHOD AND MACHINE, final judgment adverse to the patentees was rendered Dec. 9, 1980, as to claims 1, 2, 5, 6 and 7.

[*Official Gazette February 24, 1981.*]